US005137629A

United States Patent [19]

Dauchez

[11] Patent Number: 5,137,629

[45] Date of Patent: Aug. 11, 1992

[54] MAGNETIC SEPARATOR OPERATING IN A WET ENVIRONMENT

[75] Inventor: Gilbert Dauchez, Blanc-Mesnil, France

[73] Assignee: FCB, Montreuil, France

[21] Appl. No.: 629,226

[22] Filed: Dec. 18, 1990

[30] Foreign Application Priority Data

Dec. 20, 1989 [FR] France ..... 89/16880

[51] Int. Cl.[5] ..... B03C 1/035

[52] U.S. Cl. ..... 210/222; 209/223.1; 209/228; 209/232; 210/695

[58] Field of Search ..... 209/213, 223.1, 224, 209/228, 232; 210/222, 223, 695; 335/219, 298, 302

[56] References Cited

U.S. PATENT DOCUMENTS

| | | | |
|---|---|---|---|
| 2,912,106 | 11/1959 | Martin, Jr. | 209/223.1 |
| 3,375,925 | 4/1968 | Carpenter | 209/214 |
| 3,887,457 | 6/1975 | Martson et al. | 209/214 |
| 3,947,349 | 3/1976 | Fritz | 209/214 |
| 4,046,680 | 9/1977 | Fritz | 209/214 |
| 4,054,513 | 10/1977 | Windle | 209/214 |
| 4,087,358 | 5/1978 | Oder | 209/214 X |
| 4,110,222 | 8/1978 | Watson | 209/232 X |
| 4,124,503 | 11/1978 | Watson | 209/232 X |
| 4,191,591 | 3/1980 | Bender et al. | 209/214 X |
| 4,266,982 | 5/1981 | Bender et al. | 209/214 X |
| 4,317,719 | 3/1982 | Tokuno | 209/223.1 |
| 4,352,730 | 10/1982 | Dijkhuis | 209/8 |
| 4,769,130 | 9/1988 | Christensen | 209/223.1 |
| 4,772,383 | 9/1988 | Christensen | 209/223.1 |
| 4,874,508 | 10/1989 | Fritz | 209/214 |

FOREIGN PATENT DOCUMENTS

| | | | |
|---|---|---|---|
| 2655140 | 2/1978 | Fed. Rep. of Germany | 209/223.1 |
| 0649466 | 4/1979 | U.S.S.R. | 209/232 |
| 1102630 | 7/1984 | U.S.S.R. | 209/232 |
| 2067435 | 7/1981 | United Kingdom | 209/214 |

*Primary Examiner*—Michael S. Huppert
*Assistant Examiner*—Edward M. Wacyra
*Attorney, Agent, or Firm*—Collard & Roe

[57] ABSTRACT

A high-intensity magnetic separator operating in a wet environment for separating magnetic particles from a fluid material comprises a separating unit which comprises a vertically extending housing having side walls defining a separating chamber, valved ducts for alternately circulating the fluid material and a washing liquid vertically downwardly through the separating chamber, and permanent magnets arranged adjacent the side walls of the housing for generating therebetween a magnetic field extending perpendicularly to the direction of circulation of the fluid material in the separating chamber. The permanent magnets and the housing are displaceable relative to each other between a first position in which the permanent magnets are so close to the side walls of the housing that the magnetic field is intense enough to retain the magnetic particles in the separating chamber while the fluid material is circulated therethrough in a separating phase, and a second position wherein the side walls are so remote from the permanent magnets that the magnetic field is sufficiently attenuated to release the magnetic particles retained in the separating chamber while the washing liquid is circulated therethrough to evacuate the magnetic particles from the chamber in a washing phase.

8 Claims, 3 Drawing Sheets

MAGNETIC SEPARATOR OPERATING IN A WET ENVIRONMENT

BACKGROUND OF THE INVENTION

1. Field of the Invention

The present invention relates to a high-intensity magnetic separator operating in a humid environment for separating magnetic particles from a fluid material containing such particles, for example a liquid or a pulp containing the magnetic particles in suspension. Magnetic separators of this type comprise at least one vertically extending housing having side walls defining a separating chamber and means for generating a magnetic field extending perpendicularly to the direction of circulation of the fluid material in the separating chamber. The separating chamber may contain a ferromagnetic matrix permeable to the fluid material, such as an array of grooved plates, balls, expanded metal elements, iron scale or the like, to enable the fluid material to circulate through the matrix in the chamber.

2. Description of the Prior Art

The conventional magnetic separators may handle discontinuous batches of fluid material and are operated cyclically, i.e. in a separating phase the fluid material is circulated through the separating chamber while a magnetic field is applied thereto, the magnetic constituents contained in the material are retained on the housing walls and/or on the ferromagnetic matrix in the chamber, and the non-magnetic constituents are entrained by the liquid of the material and are collected; and in a subsequent washing phase the circulation of the fluid material is stopped, the magnetic field is removed, and the retained magnetic constituents are evacuated from the chamber by means of a washing liquid, usually water, circulated through the chamber under pressure. Usually, electromagnets are used for generating the magnetic field so that the same may be demagnetized readily to remove the magnetic field during the washing phase.

It has also been proposed to use permanent magnets in magnetic filters for purifying liquids charged with small amounts of magnetic particles and not requiring frequent cleaning. In such filters, the separating chamber is constituted by a replaceable casing which can be exchanged for a new one after the magnets have been detached. This type of filter cannot be used for treating materials containing substantial amounts of magnetic particles.

Continuously operating magnetic separators comprise a plurality of separating chambers arrayed in a ring or an endless chain, and the separating chambers are continuously displaced relative to fixed magnetic pole pieces arranged perpendicularly. During their continuous displacement, the separating chambers pass successively through a zone of separation, a zone of rinsing and a zone of evacuation of the magnetic particles. The fluid material is fed to the chambers in the zone of separation substantially along the entire length thereof. At the end of the separation zone, where the magnetic field is still intense, a rinsing liquid is circulated through the chambers to eliminate the non-magnetic grains of the material retained by magnetic floculation. In the evacuation zone, where the magnetic field is substantially zero, the magnetic particles are evacuated by a washing liquid fed to the chambers under pressure. These continuous action separators are heavy and cumbersome, and they are accordingly very expensive. Since they operate with electromagnets, they consume a considerable amount of electric energy.

While the literature has proposed replacing the electromagnets by permanent magnets in such separators, this has never been done in industrial applications because the intensity of the magnetic field obtainable with permanent magnets is limited in such an apparatus, due to the spacing required between the walls of the separating chambers and the magnets to permit the displacement of the chambers relative to the magnets.

SUMMARY OF THE INVENTION

It is the primary object of this invention to permit permanent magnets to be utilized in high-intensity magnetic separators operating in a humid environment and thereby to reduce the weight, the complexity and the cost of such an apparatus while saving energy consumption.

This and other objects are accomplished according to the invention in a magnetic separator of the first-indicated type by providing a separating unit comprising a vertically extending housing having side walls defining a separating chamber, means for alternately circulating the fluid material and a washing liquid vertically downwardly through the separating chamber, permanent magnet means arranged adjacent the side walls of the housing for generating a magnetic field extending perpendicularly to the direction of circulation of the fluid material in the separating chamber, and means for displacing the permanent magnet means and the housing relative to each other between a first position wherein the permanent magnet means is so close to the side walls that the magnetic field is intense enough to retain the magnetic particles in the separating chamber while the fluid material is circulated therethrough in a separating phase, and a second position wherein the permanent magnetic means is so remote from the side walls that the magnetic field is sufficiently attenuated to release the magnetic particles retained in the separating chamber while the washing liquid is circulated therethrough to evacuate the magnetic particles from the chamber in a washing phase. Each permanent magnet may be associated with a pole piece displaceable therewith.

BRIEF DESCRIPTION OF THE DRAWING

The above and other objects, advantages and features of the present invention will now be described in conjunction with certain now preferred embodiments thereof, taken in conjunction with the accompanying, somewhat schematic drawing wherein.

DETAILED DESCRIPTION OF PREFERRED EMBODIMENTS

Figure 1:
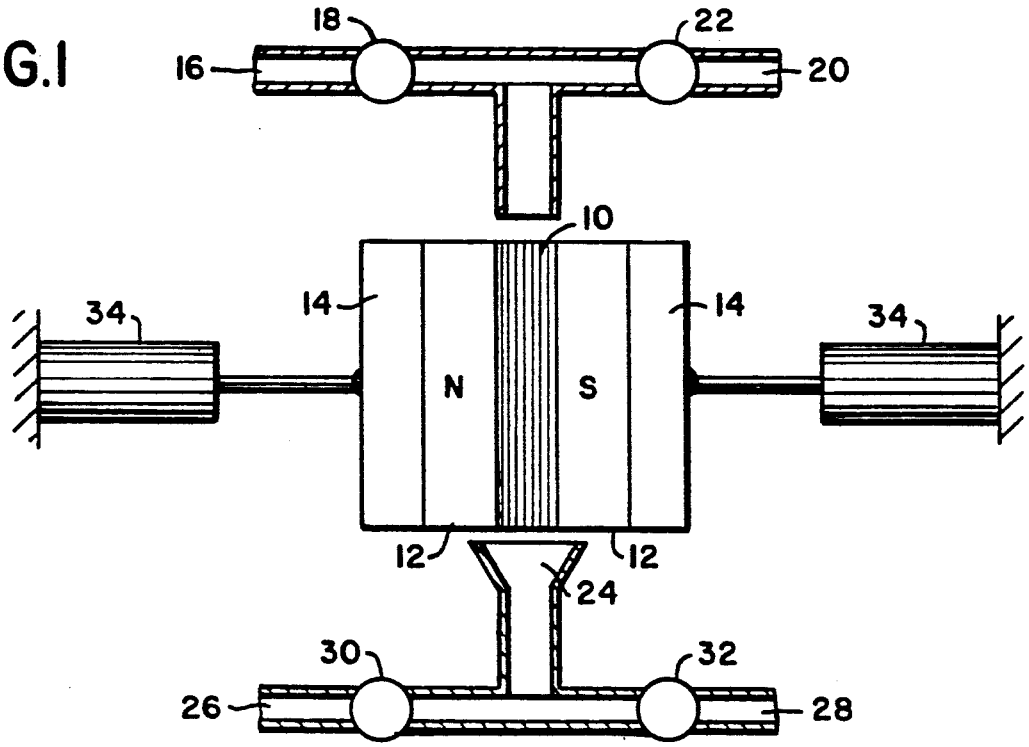
FIG. 1 is a vertical section of a separating unit according to this invention.

In the drawing, like reference numerals designate like parts operating in a like manner. Referring first to FIGS. 1 and 2, there is shown a separating unit comprising a vertically extending housing having side walls defining separating chamber 10. The separating unit also comprises means for alternately circulating a fluid material, such as a pulp, and a washing liquid, such as water under pressure, vertically downwardly through separating chamber 10. The illustrated circulating means comprises respective delivery and discharge ducts 16, 20 and 26, 28 connected respectively to an upper input end and a lower output end of separating chamber 10 for respectively delivering and discharging the fluid material (ducts 16 and 26) and the washing liquid (ducts 20 and 28) to and from chamber 10, and solenoid valves 18, 30 and 22, 32 arranged between the ducts 16, 26 and 20, 28 and the input and output ends of the chamber.

Figure 2A:
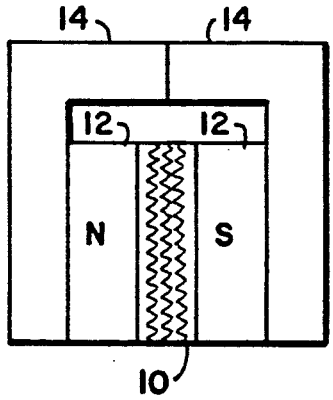
FIGS. 2*a* and 2*b* are plan views of the separating unit of FIG. 1, showing the unit respectively during the separating and washing phases.

The separating unit further comprises means for generating a magnetic field extending perpendicularly to the direction of circulation of the fluid material in separating chamber 10, the magnetic field generating means comprising permanent magnets 12 arranged adjacent the side walls of the housing, i.e. the separating chamber is arranged between the permanent magnets. In the illustrated embodiment, each permanent magnet 12 is associated with an L-shaped armature or pole piece 14 which is displaceable therewith, and the pole pieces form a closed magnetic circuit with the magnets and separating chamber 10 when the magnets are applied to the opposite side walls of the housing defining chamber 10, as shown in FIG. 2a. According to the invention, means illustrated as jacks 34 is provided for displacing permanent magnets 12 (and pole pieces 14 associated therewith) between a first position (FIGS. 2*a* and 3*a*) in contact with the side walls so that the magnetic field generated between the permanent magnets is so intense that it will retain the magnetic particles in the separating chamber while the fluid material is circulated therethrough in a separating phase, and a second position (FIGS. 2b and 3b) so remote from the side walls that the magnetic field is sufficiently attenuated to release the magnetic particles retained in the separating chamber while the washing liquid is circulated therethrough to evacuate the magnetic particles from the chamber in a washing phase.

The operation of jacks 34 and solenoid valves 18, 30 and 22, 32 is preferably programmed to open valves 18, 30 in delivery and discharge ducts 16, 26 for the fluid material in the separating phase while jacks 34 displace permanent magnets 12 towards the side walls of the housing and valves 22, 32 in delivery and discharge ducts 20, 28 for the washing liquid are closed, and to close valves 18, 30 in delivery and discharge ducts 16, 26 for the fluid material in the washing phase while jacks 34 displace permanent magnets 12 away from the side walls of the housing and valves 22, 32 in delivery and discharge ducts 20, 28 for the washing liquid are opened.

The housing is tubular and the walls are of a nonmagnetic material. As shown in FIGS. 1 and 2, the tubular housing may be of rectangular cross section and is open on top and on the bottom. The separating chamber contains a ferromagnetic matrix permeable to the fluid material, such as corrugated plates defining vertically extending grooves or equivalent ferromagnetic fillings, including bars, expanded metal elements, scale or iron and like soft magnetic elements defining gradients of magnetic field in the gaps therebetween to permit magnetic particles contained in the fluid material flowing through chamber 10 to be retained on the matrix elements.

Collector 24 is placed below the lower discharge end of chamber 10 to receive the purified fluid material and the magnetic particles, respectively, from the separating chamber during the separating and washing phases, and the collector is connected to discharge ducts 26 and 28 so that the collected purified fluid material and the magnetic particles may be separately removed.

The operation of the separating unit will be obvious from the above description of its structure and will now be described in detail:

During the separating phase, magnets 12, 14 are applied to the large side walls of the housing defining separating chamber 10, as illustrated in FIGS. 1 and 2*a*, solenoid valves 18, 30 are opened to permit the fluid material containing magnetic particles to flow through the separating chamber vertically downwardly, and solenoid valves 22, 32 are closed. The fluid material passes between the corrugated or grooved plates in chamber 10 where the magnetic particles are subjected to forces of attraction exerted by the magnetized plates and are retained thereon. The purified fluid material is received in collector 24 and evacuated through discharge duct 26.

Figure 2B:
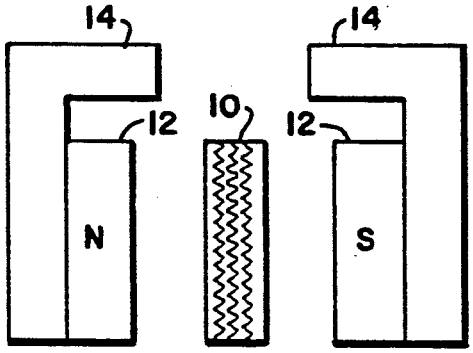

During a subsequent washing or scavenging phase shown in FIG. 2b, magnets 12, 14 are moved apart sufficiently to remove the magnetic field from chamber 10. Valves 18, 30 are closed and solenoid valves 22, 32 are opened to permit a washing liquid, such as water under pressure, to flow through the separating chamber, and since the magnetic particles will no longer be retained on the de-magnetized matrix in chamber 10, the washing liquid will scavenge the chamber and entrain the magnetic particles into collector 24 and through discharge duct 28. The duration of each phase may be predetermined, particularly if the content of magnetic particles in the fluid material is more or less constant. On the other hand, the separating phase may be terminated in response to a predetermined degree of clogging of chamber 10, for example in response to a control signal indicating a predetermined flow rate of the fluid material through chamber 10 or a predetermined loss of pressure at the output end of the chamber. During the washing or scavenging phase, the distance of the magnets 12, 14 from separating chamber 10 must be sufficient to assure a drop of the magnetic field in the chamber to substantially zero, i.e. the lines of the magnetic field forces will be closed in the gaps between the housing walls and the remote magnets, extending between the poles of magnets 12, 14.

Figure 3A:
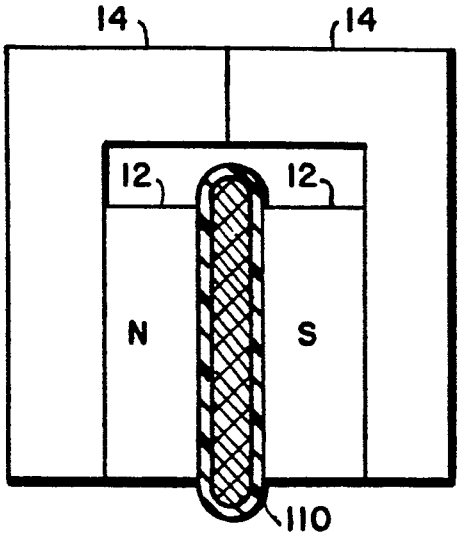
FIGS. 3*a* and 3*b* are analogous views, showing another embodiment of the separating chamber.
Figure 3B:
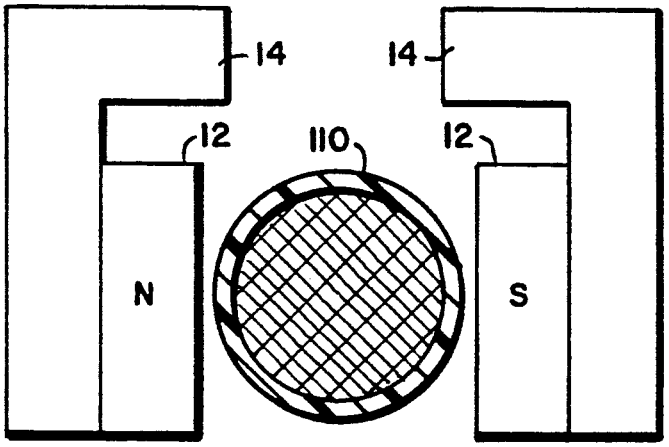

As shown in FIGS. 3*a* and 3*b*, the housing may be constituted by a section of a tube 110 of substantially circular cross section (FIG. 3*b*), the walls being of an elastic material deformable upon displacement of the permanent magnets into the first position (FIG. 3*a*) to impart a flattened cross section to the tube. The elastic material may be natural or synthetic rubber, and the separating chamber is filled with a readily compressible matrix, such as iron scale, which does not interfere with the deformation of the tube and its return to a circular cross section. Longitudinally disposed fibers of soft magnetic material or such fibers interwoven to form a tubular sheath may be embedded in the wall of tube 110 to create gradients of the magnetic field at the interior face of the tube wall.

Figure 4:
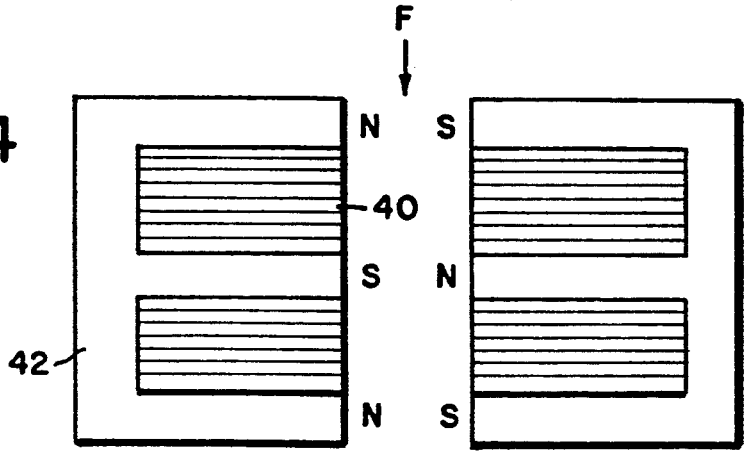
FIG. 4 is a plan view showing another embodiment of the permanent magnets.

Permanent magnets 12 may be comprised of assemblies of magnetic elements whose direction of magnetization is perpendicular to the direction of circulation of the fluid material in the separating chamber, i.e. the side walls of the housing defining chamber 10. The magnetic elements are bonded to each other and consist of a samarium-cobalt alloy or a neodymium-iron-boron alloy. Alternatively and as shown in FIG. 4, each permanent magnet may be comprised of a stack of permanent magnetic elements 40 and pole pieces 42, the direction of magnetization of the magnetic elements extending parallel to the direction of circulation of the fluid material in the separating chamber, as indicated by arrow F. The pole pieces disposed at opposite sides of the separating chamber may extend in the same plane perpendicularly to the direction of flow of the fluid material and may be of the same polarity or of opposite polarity, or they may be vertically staggered from each other by a half step.

If the magnetic separator has a single separating chamber, it operates discontinuously. If a continuous operation is desired, several like separating units must be associated with each other, and means is provided for cyclically connecting the separating chamber of each unit to the means for alternately circulating the fluid material and the washing liquid vertically downwardly through the separating chamber, the fluid material being circulated through the separating chamber of one unit while the washing liquid is circulated through the separating chamber of the other unit.

Figure 5:
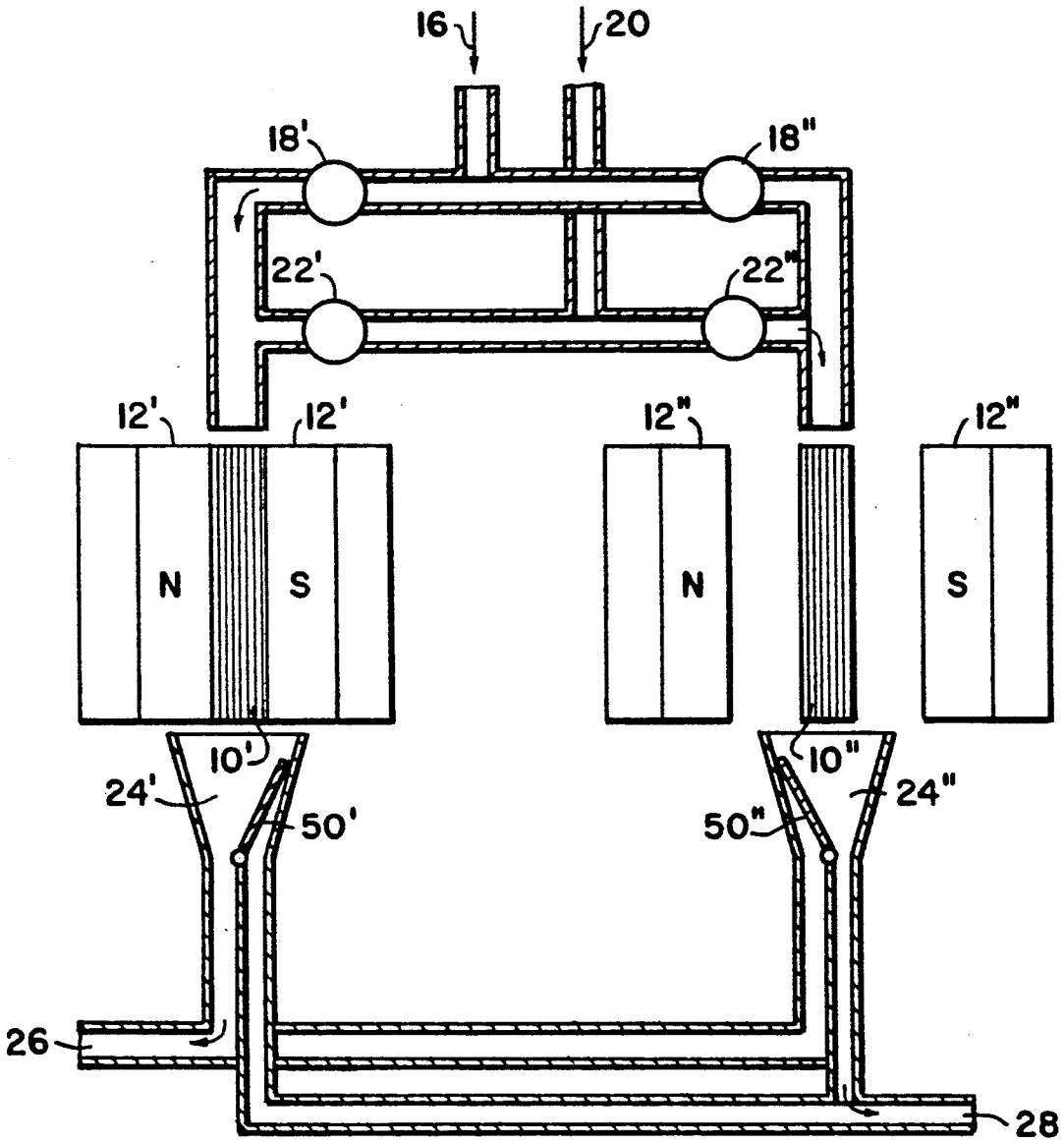
FIG. 5 is a view similar to that of FIG. 1, showing two associated separating units coordinated to obtain a continuous operation.

Generally and when the washing or scavenging phase is shorter than the separating phase, two coordinated separating units will suffice, and such a continuous action magnetic separator has been diagrammatically illustrated in FIG. 5. In the illustrated embodiment, separating chambers 10', 10'' and the ducts connected thereto are fixed. As shown, delivery duct 16 feeding the fluid material containing magnetic particles to the separating chambers and delivery duct 20 feeding the washing or scavening liquid under pressure to the separating chambers are connected to the upper input ends thereof by solenoid valves 18', 18'' and 22', 22'', respectively. Collectors 24' and 24'' are placed under separating chambers 10' and 10'' for respectively receiving the purified fluid material or the scavenged magnetic particles washed out of the chambers by the washing liquid, and pivotal flap valves 50' and 50'' are placed in the collectors for selectively guiding the collected fluid material or the scavenged magnetic particles to discharge ducts 26 or 28 for the purified fluid material and the scavenged magnetic particles. As shown by the positions of displaceable permanent magnets 12' and 12'' associated with separating chambers 10' and 10'' of the two separating units, the two units are so operated that one unit operates in the separating phase while the other unit operates in the washing or scavenging phase. The displacement of the permanent magnets and the opening and closing of the valves controlling the flow of the fluid material and the washing liquid through the separating chambers are so programmed or controlled by a microprocessor that the two units will be cyclically switched from one phase to the other, one of the units always operating in the separating phase.

The number of separating units in the installation will depend on the flow rate of the fluid material to be purified. Using standard units for the installation reduces the costs and facilitates maintenance since any faulty unit may be readily replaced by a like unit.

If desired, an intermediate rinsing step, during which the magnetic field is maintained, may precede the washing or scavenging step to eliminate non-magnetic granular material retained in the separating chamber by magnetic floculation.

While the invention has been illustrated in conjunction with embodiments wherein the permanent magnet means is displaced relative to the separating chamber to apply and remove the magnetic field generated thereby, the same result will be achieved if the separating chamber is displaced relative to the permanent magnet means, i.e. if the separating chamber is displaceable and the permanent magnet means is fixed. In this case, means is provided for displacing the separating chamber between a first zone wherein the permanent magnet means is in contact with the side walls of the housing defining the separating chamber and this zone is equipped with the delivery and discharge ducts for feeding and discharging the fluid material to and from the chamber, and a second zone wherein the permanent magnet means is remote from the side walls and this zone is equipped with the delivery and discharge ducts for feeding and discharging the washing liquid to and from the chamber. If two separating units are provided, as shown in FIG. 5, the displacements may be alternating, with the programmed alternating operation of the solenoid valves providing the desired cyclical operation.

If more than two separating units are provided, they are connected to each other in a ring formation or an endless chain, the units being displaced step by step and in the same direction between the permanent magnet means. Several separating and washing zones may be provided along the ring or endless chain, and the longitudinal movement of the separating chambers is accompanied by a transverse displacement of the permanent magnet means when the separating chambers pass from one zone into the other.

In a modified embodiment, each separating unit comprises two or more separating chambers successively guided between the permanent magnet means in a separating zone comprising the ducts for feeding and discharging the fluid material to and from each separating chamber in this zone, and away from the separating zone to a washing zone equipped with ducts for feeding and discharging the washing fluid to and from each chamber. The permanent magnet means is displaced towards the separating chamber in the separating zone for separating the magnetic particles in the fluid material and is periodically displaced away from the separating chamber to permit its displacement into the washing zone.

Since the permanent magnets and/or the pole pieces associated therewith at the opposite sides of the housing defining the separating chamber are of opposite polarity, the displacement means must be able to exert a strong enough force to overcome the magnetic force of attraction. A part of the required energy may be recuperated during the approaching movement of the permanent magnets, particularly if several sequentially operating units are used.

What is claimed is:

1. A high-intensity magnetic separator operating in a wet environment for separating magnetic particles from a fluid material containing said particles, the magnetic separator comprising at least one separating unit which comprises (a) a vertically extending housing having side walls defining a separating chamber, (b) means for alternately circulating the fluid material and a washing liquid vertically downwardly through the separating chamber, (c) permanent magnet means arranged adjacent the side walls of the housing for generating therebetween a magnetic field extending perpendicularly to the direction of circulation of the fluid material in the separating chamber, and (d) means for displacing the permanent magnet means relative to each other and to the separating chamber between a first position in which the permanent magnet means are in contact with the side walls of the housing so that the magnetic field is intense enough to retain the magnetic particles in the separating chamber while the fluid material is circulated therethrough in a separating phase, and a second position wherein the permanent magnet means are so remote from the side walls of the housing that the magnetic field is sufficiently attenuated to allow the magnetic particles retained in the separating chamber to be released while the washing liquid is circulated therethrough to evacuate the magnetic particles from the chamber in a washing phase.

2. The magnetic separator of claim 1, wherein the permanent magnet means comprises two displaceable permanent magnets each of which is associated with a pole piece displaceable therewith.

3. The magnetic separator of claim 1, wherein the circulating means comprises respective delivery and discharge ducts connected respectively to an upper input end and a lower output end of the separating chamber for respectively delivering and discharging the fluid material and the washing liquid to and from the chamber, and solenoid valves arranged between the ducts and the input and output ends of the chamber, and wherein the operation of the displacing means and solenoid valves are so programmed that the valves in the delivery and discharge ducts for the fluid material are open while the permanent magnets are in contact with the side walls of the housing and the valves in the delivery and discharge ducts for the washing liquid are closed in the separating phase, and the valves in the delivery and discharge ducts for the fluid material are closed while the permanent magnets are remote from the side walls of the housing and the valves in the delivery and discharge ducts for the washing liquid are opened in the washing phase.

4. The magnetic separator of claim 1, wherein the housing is tubular and the walls are of a non-magnetic material, the separating chamber containing a ferromagnetic matrix permeable to the fluid material.

5. The magnetic separator of claim 1, wherein the housing is constituted by a section of a tube of substantially circular cross section and the walls are of an elastic material deformable upon displacement of the permanent magnet means into the first position to impart a flattened cross section to the tube, the separating chamber containing a compressible matrix permeable to the fluid material.

6. The magnetic separator of claim 1, wherein the permanent magnet means is comprised of two permanent magnets each including assemblies of magnetic elements whose direction of magnetization is perpendicular to the direction of circulation of the fluid material in the separating chamber.

7. The magnetic separator of claim 1, wherein the permanent magnet means is comprised of two permanent magnets each including stacks of magnetic elements and pole pieces, the direction of magnetization of the magnetic elements extending parallel to the direction of circulation of the fluid material in the separating chamber.

8. The magnetic separator of claim 1, comprising two of said separating units, and means for cyclically connecting the separating chamber of each unit to the means for alternately circulating the fluid material and the washing liquid vertically downwardly through the separating chamber, the fluid material being circulated through the separating chamber of one unit while the washing liquid is circulated through the separating chamber of the other unit.

* * * * *